United States Patent [19]

Kicherer et al.

[11] Patent Number: 4,650,969

[45] Date of Patent: Mar. 17, 1987

[54] ELECTRIC HOTPLATE

[75] Inventors: Robert Kicherer, Knittlingen; Stefan Reif, Oberderdingen, both of Fed. Rep. of Germany

[73] Assignee: E.G.O. Elektro-Geräte Blanc u. Fischer, Fed. Rep. of Germany

[21] Appl. No.: 569,607

[22] Filed: Jan. 10, 1984

[30] Foreign Application Priority Data

Jan. 15, 1983 [DE] Fed. Rep. of Germany ..... 3301219

[51] Int. Cl.[4] ..... H05B 3/68

[52] U.S. Cl. ..... 219/451; 219/457; 219/458

[58] Field of Search ..... 219/445, 446, 447, 449, 219/451, 452, 453, 457, 458, 459, 463, 464, 507, 509, 541, 351, 403, 436

[56] References Cited

U.S. PATENT DOCUMENTS

| | | | |
|---|---|---|---|
| 2,101,110 | 12/1937 | Thornton, Jr. | 219/457 |
| 2,199,650 | 5/1940 | Price | 219/457 |
| 2,301,085 | 11/1944 | Smith | 219/457 |
| 4,122,330 | 10/1978 | Fischer et al. | 219/449 |
| 4,153,833 | 5/1979 | Fischer et al. | 219/449 |
| 4,386,263 | 5/1983 | Fischer et al. | 219/452 X |

FOREIGN PATENT DOCUMENTS

| | | |
|---|---|---|
| 1021967 | 1/1958 | Fed. Rep. of Germany . |
| 1270201 | 6/1968 | Fed. Rep. of Germany . |
| 2442717 | 3/1976 | Fed. Rep. of Germany . |
| 2620004 | 1/1978 | Fed. Rep. of Germany . |
| 2651848 | 5/1978 | Fed. Rep. of Germany . |
| 2933349 | 3/1981 | Fed. Rep. of Germany . |
| 2003005 | 2/1979 | United Kingdom . |

*Primary Examiner*—E. A. Goldberg
*Assistant Examiner*—Teresa J. Walberg
*Attorney, Agent, or Firm*—Steele, Gould & Fried

[57] ABSTRACT

A hotplate has on the bottom of its hotplate body (11) a cover plate (15), through which is passed an electric conductor (18) mounted in an insulating bushing (19) and which only slightly projects over the end of the insulating bushing (19). For automatically placing the hotplate in a stove unit, electrical connecting lines (21) are guided by a positioning member (20) which can be fixed to the rim (14) of the hotplate body (11). On the inside, the connecting lines project far enough to be brought into contact with the electrical conductor (18) passing through the cover plate.

18 Claims, 10 Drawing Figures

ELECTRIC HOTPLATE

BACKGROUND OF THE INVENTION

The invention relates to an electric hotplate with a hotplate body and a lower cover plate, through which cover plate passes an insulating member for the passage of the electric hotplate terminal lines for powering heating elements and from which the terminal lines project in stub-like manner.

In known hotplates (cf e.g. Offenlegungscchrift No. 2,651,848), the electrical connection of the hotplate takes place by means of a ceramic connection piece. The piece is located on one end of a support plate. The piece is fixed to the lower cover plate of the hotplate. The insulating member projects through the cover plate and the support plate in the vicinity of the inner end of said support plate. Terminal lines constructed as solid bars or wires pass through the support plate and run parallel to the latter into the connecting piece. The fixed arrangement of the connecting piece has proved satisfactory, because it is located outside the hot region of the hotplate and permits the connection of electric leads. However, as the connecting piece projects laterally over the hotplate, such hotplates are not very suitable for the automatic equipping of stove units.

It has already been proposed (Offenlegungscchrift No. 2,933,349), for the purpose of improving hotplates with regards to the storage and transportation possibilities, to make the thermally stable, insulated terminal lines leading out of the hotplate flexible, and to guide them to a common, freely movable connecting piece with terminals. The terminal lines must be sufficiently long to permit the arrangement of the connecting piece outside the vicinity of the electric hotplate. This constructional embodiment has proved particularly satisfactory for storage and transportation.

A hotplate is also known (Auslegeschrift No. 1,270,201), in which the mounting bars or rails for the electric heating resistors are passed through a bushing and terminate in flat lugs. The power supply line can be connected to said lugs by means of the flat plugs provided at the end thereof. However, this constitutes a relatively costly construction, which is not very suitable for automatically equipping stove units with hotplates.

A hotplate is also known (Offenlegungsschrift No. 2,620,004), in which stubs of the terminal lines project through an insulating member, the mounting rails of a thermostat being welded to the short ends. The thermostat is part of the hotplate and is joined therewith at the time of manufacture. It projects laterally over and beyond the hotplate and is connected to the feed leads at its outside by means of electric terminals.

SUMMARY OF THE INVENTION

The object of the invention is to provide an electric hotplate, which is particularly suitable for automated mounting in stove units.

According to the invention, this object is achieved in the case of an electric hotplate in which the insulating member is arranged in the marginal area of the hotplate and the outwardly projecting stub ends of the hotplate terminal lines can be connected to lines projecting out of a positioning part. As a result, the positioning part is part of the stove unit and is positioned relative to the hotplate by the automatic means making up the stove unit so that immediately upon positioning welding can take place. Therefore, the positioning part and the short stub ends projecting from the insulating member ensure a precise positioning and securing. The short ends of the terminal wires are normally always directly arranged over the passage openings of the insulating member, so that the positioning of both the terminal lines and the feed leads is always precise.

The invention also proposes that the positioning part can be fixed to the hotplate body, particularly to the lower edge of its rim.

According to a further development, the positioning member has a number of spaced passages corresponding to the number of spaced terminal lines. This permits the use of uninsulated wire in connection with the positioning part. The passages can both be holes and in particular clamping slots, in which the feed leads can be particularly easily placed.

The reciprocal arrangement of positioning part and hotplate can take place in such a way that the feed leads of the positioning part are biased to engage the ends of the terminal wires. For example, this can be achieved in that the feed leads are given a certain pretension. It is also advantageously possible for the spacing of the passages in the positioning part to correspond to the spacing of the terminal lines projecting out of the insulating part.

According to a further development, the hotplate body has a marking, catch, or the like for aligning the positioning part. This catch can be a simple pin or a slot, so that the automatic means then automatically brings the positioning part into the correct position.

The invention also proposes that electrical connecting lines are fixed in the positioning part.

According to a further development, when the positioning part is secured, the connecting line ends are placed in contact with the associated terminal lines.

BRIEF DESCRIPTION OF THE DRAWINGS

The invention is described in greater detail hereinafter relative to non-limitative embodiments and with reference to the attached drawings, wherein.

DETAILED DESCRIPTION OF THE EMBODIMENTS

Figure 1:
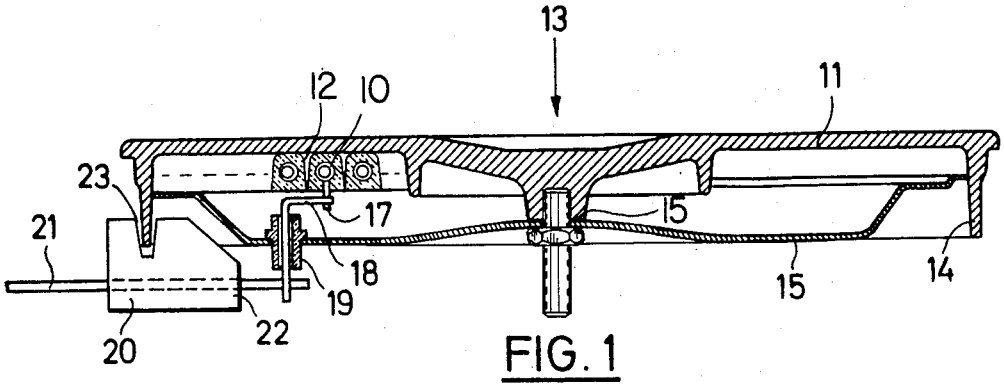
FIG. 1 is a diagrammatic cross-section through a hotplate constructed according to the invention.

The hotplate shown in FIG. 1 essentially comprises a hotplate body 11, on whose bottom surface heating elements such as resistors are placed in an embedding material 12. The heating resistors 10 are not shown in detail. A cylinder ring-like rim 14 passes round the complete hotplate body 11. The hotplate is closed off at the bottom by a cover plate 15, whose periphery engages on the embedding material 12 and by its center point is fixed to the central bolt 16 of hotplate body 11, preferably by screwing. A terminal 17 of the electrical hotplate heating system is welded to a terminal line 18 extending from the interior between cover plate 15 and embedding material 12 towards the outside through an insulating member 19. Insulating member 19 is held in an opening in cover plate 15, so that the non-insulated terminal line 18 is electrically insulated against the sheet metal parts. The terminal line only projects by a short stub portion over the outer end of insulating member 19.

A positioning member 20 is arranged on the left-hand side in FIG. 1 in the vicinity of insulating member 19 and through member 20 the connecting lines 21 lead to a power supply or to a control device. The connecting lines project far enough beyond the inner end 22 of positioning member 20, that they are at least in contact with the projecting stub ends of terminal lines 18. FIG. 1 shows only one terminal line 18 and one connecting line 21, although obviously several such lines exist in the case of hotplates. At the intersection point of terminal line 18 and connecting line 21, welding takes place, so that the two lines are electrically and mechanically fixed to one another.

Figure 10:
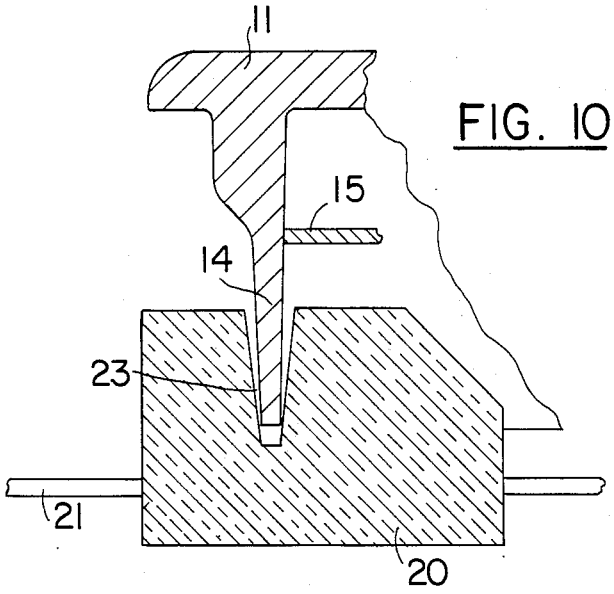
FIG. 10 is a detail view from FIG. 1.

On its top surface, positioning member 20 has a notch 23, which engages rim 14 of hotplate body 11. The dimensions of notch 23 can be selected in such a way that positioning member 20 is fixed as a result thereof (see FIG. 10).

It is also possible for rim 14 of hotplate body 11 to have a cutout, which engages in a corresponding slot in positioning member 20, so that a fixed positioning of member 20 is ensured.

Figure 2:
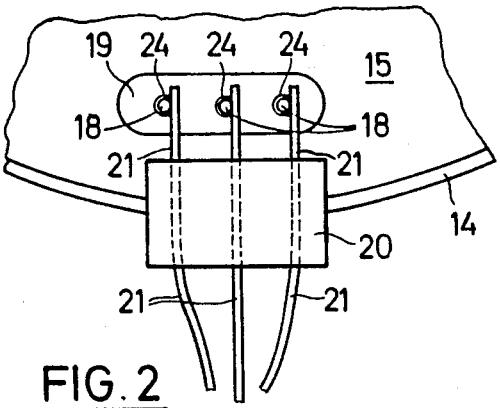
FIG. 2 is a partial view of the hotplate of FIG. 1 from below.

FIG. 2 is a partial view from below of the hotplate shown in FIG. 1. It can be seen that the insulating member 19 has an elongated shape with three spaced holes 24. A terminal line 18 extends through each hole 24 and in FIG. 2, line 18 passes in a linear form in the extension of hole 24.

Three ends of the connecting lines extend out of the positioning member in the direction of the hotplate and it can also be seen that the hotplate-side ends of the connecting lines project somewhat over the terminal lines 18. Welding or some other fixing is done at the contact point between connecting lines 21 and terminal lines 18. In the case of the embodiment of FIG. 2 the positioning member 20 has three holes running in the direction of connecting lines 12 and through which can be passed the wires.

Figure 3:
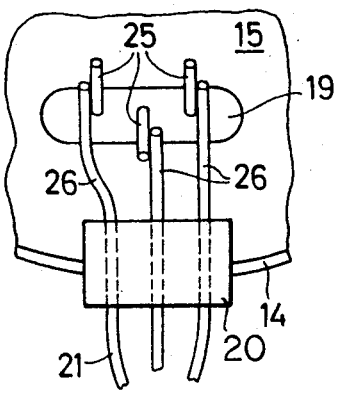
FIG. 3 is a partial view, similar to FIG. 2, of a modified embodiment.

FIG. 3 shows a slightly modified embodiment compared with that of FIG. 2. In this case, the ends 25 of connecting lines 18 are bent to the side somewhat above insulating member 19, and the corresponding ends 26 of connecting lines 21 are also bent somewhat. The ends 26 of the connecting lines engage from the outside on the ends 25 of the terminal lines 18, under a certain pretension. The end of the central connecting line 21 also engages with a certain pressure on the end of the central terminal line 18. In such a construction, in which the appropriate ends of the lines engage on one another with pretension, a particularly simple and reliable fixing of the ends to one another is made possible, preferably by welding.

Figure 4:
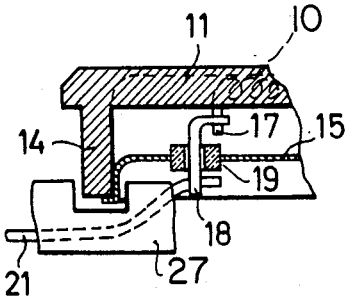
FIG. 4 is a partial section corresponding to FIG. 1 in the case of another embodiment.

FIG. 4 shows a partial section, similar to FIG. 1, through a hotplate with a hotplate body 11, which is surrounded by a rim 14. In this case, the hotplate is particularly flat, so that it is possible to pass the terminal line 18 out of the insulating member 19, without its lower end protruding beyond rim 14 of the hotplate body 11. In this case, the transit of the connecting line 21 is bent, so that the intersection point between the two lines can also still be above the bottom of rim 14.

Figure 5:
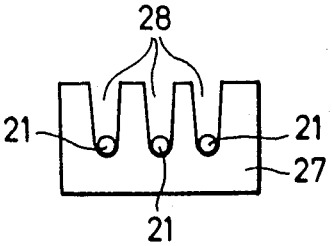
FIG. 5 is a view of a connecting piece.

FIG. 5 shows another construction of a positioning member 27 in which case it has a total of three slots 28, which taper slightly downwards. As a result of the taper, the connecting lines 21 can be relatively easily placed in the slots and are secured therein by corresponding pressure application.

Figure 6:
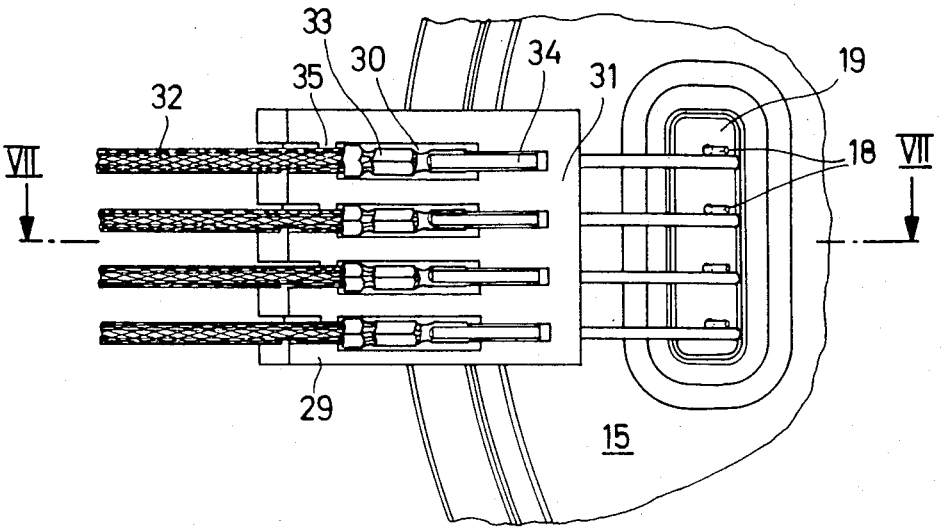
FIGS. 6 to 9 are views of further embodiments.

In the preferred embodiment of the invention shown in FIG. 6, the positioning member 29 has four slots 30 which, on the side of the positioning member 29 facing insulating member 19, are bridged by a transverse web 31. Within slot 30 the ends of the insulating connecting lines 32 are connected with the aid of a multicore cable terminator 33 to terminal wires 34, which project from the positioning member 29 on the side thereof facing insulating member 19 and are welded to the terminal lines 18 of the electrical hotplate.

The stranded cable terminators 33 are connected in conventional manner to the connecting lines 32, and the opposite end thereof is welded to the terminal wires 34. For this purpose, the ends of the terminal wires can be squeezed flat. The multicore cable end connectors are preferably made from nickel-plated steel, so that they can easily be welded to the thermally stable terminal wire 34. The welding between the terminal wire 34 and the terminal line 18 is also facilitated. The embodiment shown in FIG. 6 has the particular advantage that the copper-insulated connecting lines 32 are positioned outside the directly heated region, so that neither the wires, nor the insulation are exposed to excessively high temperatures.

Through the arrangement of the multicore cable end connectors 33 within slots 30, it is also ensured that both the connecting lines 32 and the terminal wires 34 are firmly anchored, which is particularly important for the automatic equipping of cooking appliances. For this purpose, constrictions 35 are preferably provided, which prevent any movement to the left in FIG. 6, while a further movement to the right is prevented by the shape of the slots 30 and the multicore cable end connectors 33, which are wider than the further-extending slot.

Figure 7:
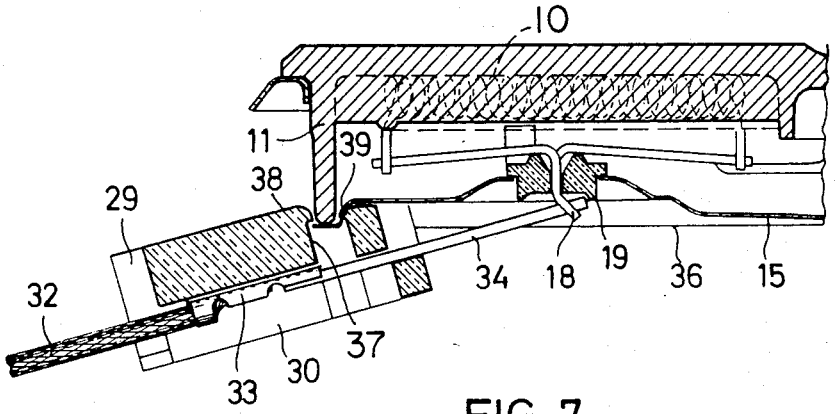

FIG. 7 shows a section approximately along line VII—VII through the arrangement according to FIG. 6. It can be seen that the insulating member 19 is indented or countersunk in the cover plate 15 and that the end of terminal line 18 projecting out of the insulating member is bent down to the right. It can be seen that the lower end of the terminal line 18 does not extend over the plane of the lower boundary of the hotplate body 11 illustrated by line 36, so that the hotplate manufactured in the factory can be directly stacked on another hotplate, without there being any damage to the top surface of the hotplate immediately below it. The downward bending of the terminal line 18 has the further advantage that the connection to the terminal wire 34 forms an angle, which is roughly a right angle. Through adopting such a crossing procedure, it is possible to carry out cross-resistance welding with conventional welding tongs.

As can also be seen from FIG. 7, the positioning member 29 has a transversely directed slot 37, whose edge has two inwardly-directed protrusions or beaks 38, 39. The outer beak 38 engages behind the outer edge of cover plate 15, while the inner beak 39 engages in a corresponding opening in cover plate 15, thereby holding positioning member 29 in place.

As illustrated in FIGS. 6 and 7, the connecting lines 32 are insulated up to their connection with the cable terminators leading to terminal wires 34, so that outside the positioning member 29, contact between the individual connecting lines 32 cannot cause any damage, while on the other side of positioning member 29, the rigid terminal wires 34 cannot come into contact with one another.

Figure 8:
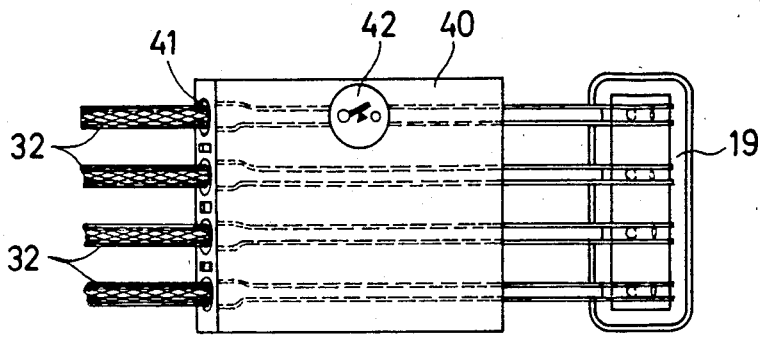

FIG. 8 diagrammatically shows another positioning member 40, which has four bushings 41 for the connecting lines 32. On the right-hand side of positioning member 40, the terminal wires are once again connected to the terminal lines of the insulating member 19. As is only diagrammatically shown in FIG. 8, the positioning member 40 contains a thermostat 42 which, on exceeding a given temperature, opens a circuit. This embodiment makes it unnecessary to install further thermostats when fitting the stove unit.

Figure 9:
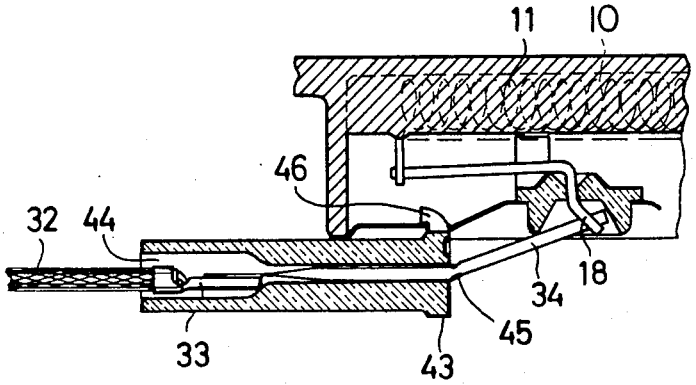

FIG. 9 shows another embodiment of a positioning member 43. In this case, the positioning member has no slots and instead has longitudinally directed bores 44, which have a larger diameter on the side of positioning member 43 remote from the hotplate and which is reduced approximately in the center of positioning member 43. The connecting line 32 is connected to a multicore cable end connector 33 whose right-hand end is welded to the flattened end of the terminal wire 34. As a result of the special shaping of bore 44 of positioning member 43, a displacement to the right of connecting line 32 and terminal wire 34 is prevented. In order to prevent the terminal wires 34 from being drawn out of the positioning member 43, terminal wire 34 is squeezed in the vicinity of its outlet 45 from positioning member 43. It can also be seen from FIG. 9 that the terminal wire 34 and the lower end of the terminal line 18 cross one another, so that it is possible to carry out cross-resistance welding with conventional welding tongs. It can also be seen that the terminal line 18 does not project over the lower edge of the hotplate body 11. On its top surface, positioning member 43 has a beak 46, which engages in a corresponding opening of cover plate 15. The positioning member 43 is also supported on the lower edge of hotplate body 11. This embodiment offers the particular advantage that, even when welding has been done, positioning member 43 can be turned to a certain extent, but is still undetachably joined with the hotplate.

The hotplate proposed by the invention has the further advantage that if a hotplate fails in an installed cooker, i.e. in a so-called service case, the round wire extension can be separated. It is then possible to fit the new hotplate with conventional means, i.e. the ends of the terminal wires 34 projecting out of the positioning member can be screwed to conventional screw terminals. This is additionally facilitated by the fact that the spacing of the terminal wires 34 corresponds to the spacing of the screw terminals of a conventional hotplate.

What is claimed is:

1. An electric hotplate having electric heating elements adapted for automatic connection to electric power connecting lines, the hotplate comprising:

a hotplate body of highly thermally conductive material, the electric heating elements being positioned and secured to a bottom surface of the hotplate body and electrically insulated therefrom;

a lower cover plate attached on the underside of the hotplate body;

an electrically insulating mounting member arranged in a marginal region of the hotplate, the insulating member extending through the lower cover plate and carrying electric hotplate terminal lines from the heating elements in spaced relation, the terminal lines having stubs projecting from the insulating member; and, an electrically insulated positioning member for engaging the electric connecting lines and holding portions of the connecting lines at predetermined positions to ensure contact between the stubs and the portions, respectively, to facilitate automatic connection of respective stubs and portions to one another, the electrically insulating positioning member being a high temperature material, mounted on at least one of the lower cover plate and a peripheral extending rim of the hotplate body and being at least partly supported by the rim, the positioning member being shaped to engage the rim.

2. The electric hotplate according to claim 1, wherein the positioning member is fixed to the hotplate body by a notch in the positioning member, the rim of the hotplate and the notch being dimensioned to engage tightly.

3. The electric hotplate according to claims 1 or 2, wherein the positioning member has a number of spaced passages, each of the passages carrying one of the connecting lines.

4. The electric hotplate according to claim 1, wherein the positioning member has passages for the electric connecting lines, the connecting lines including terminal wires and the spacing of passages in the positioning member corresponding to the spacing of the terminal line stubs projecting from the insulating member.

5. The electric hotplate according to claim 1, wherein the connecting lines are fixed in the positioning member.

6. The electric hotplate according to claim 5, wherein the connecting lines have end connectors in electrical contact with corresponding terminal wires, the terminal wires being connected to the terminal lines carried in the insulating member.

7. The electric hotplate according to claim 1, wherein the connecting lines are flexible and the positioning member carries the connecting lines and terminal wires attached to the connecting lines, the terminal wires connecting to the terminal line stubs projecting out from the insulating member.

8. The electric hotplate according to claim 7, wherein the connecting lines include a multicore cable end connector fitted to the connecting line and to which is welded a terminal wire.

9. The electric hotplate according to claim 7, wherein the flexible connecting lines are insulated up to a connection point with the terminal wires leading to the terminal stubs.

10. The electric hotplate according to claim 1, wherein the positioning member has passages having a stepped diameter.

11. The electric hotplate according to claim 1, wherein the stubs projecting out of the insulating member are bent over such that the stubs intersect the connecting lines roughly at a right angle.

12. The electric hotplate according to claim 1, wherein the positioning member has a thermostat operable to control the hotplate.

13. The electric hotplate according to claim 1, wherein the connecting lines for the terminal wires on a side of the positioning member facing the hotplate are spaced to correspond to the spacing of conventional hotplate terminals.

14. An electric hotplate having electric heating elements adapted for automatic connection to electric power connecting lines, the hotplate comprising:

a hotplate body of highly thermally conductive material, the electric heating elements being positioned and secured to a bottom surface of the hotplate body and electrically insulated therefrom;

a lower cover plate attached on the underside of the hotplate body;

an electrically insulating mounting member arranged in a marginal region of the hotplate, the insulating member extending through the lower cover plate and carrying electric hotplate terminal lines from the heating elements in spaced relation, the terminal lines having stubs projecting from the insulating member; and, an electrically insulated positioning member for engaging the electric connecting lines and holding portions of the connecting lines at predetermined positions to ensure contact between the stubs and the portions, respectively, to facilitate automatic connection of respective stubs and portions to one another, the electrically insulating positioning member being a high temperature material, mounted on at least one of the lower cover plate and a peripheral rim of the hotplate body and being at least partly supported by the rim, the hotplate body having a catch for aligning the positioning member with respect to the hotplate body.

15. An electric hotplate having electric heating elements adapted for automatic connection to electric power connecting lines, the hotplate comprising:

a hotplate body of highly thermally conductive material, the electric heating elements being positioned and secured to a bottom surface of the hotplate body and electrically insulated therefrom;

a lower cover plate attached on the underside of the hotplate body;

an electrically insulating mounting member arranged in a marginal region of the hotplate, the insulating member extending through the lower cover plate and carrying electric hotplate terminal lines from the heating elements in spaced relation, the terminal lines having stubs projecting from the insulating member; and, an electrically insulated positioning member for engaging the electric connecting lines and holding portions of the connecting lines at predetermined positions to ensure contact between the stubs and the portions, respectively, to facilitate automatic connection of respective stubs and portions to one another, the electrically insulating positioning member being a high temperature material, mounted on at least one of the lower cover plate and a peripheral rim of the hotplate body and being at least partly supported by the rim;

the electric terminal lines having connecting lines fixed in the positioning member, and at least one of the hotplate-side end of the connecting lines and the terminal wires being deformed at a point adjoining the positioning member.

16. An electric hotplate having electric heating elements adapted for automatic connection to electric power connecting lines, the hotplate comprising:

a hotplate body of highly thermally conductive material, the electric heating elements being positioned and secured to a bottom surface of the hotplate body and electrically insulated therefrom;

a lower cover plate attached on the underside of the hotplate body;

an electrically insulating mounting member arranged in a marginal region of the hotplate, the insulating member extending through the lower cover plate and carrying electric hotplate terminal lines from the heating elements in spaced relation, the terminal lines having stubs projecting from the insulating member; and, an electrically insulated positioning member for engaging the electric connecting lines and holding portions of the connecting lines at predetermined positions to ensure contact between the stubs and the portions, respectively, to facilitate automatic connection of respective stubs and portions to one another, the electrically insulating positioning member being a high temperature material, mounted on at least one of the lower cover plate and a peripheral rim of the hotplate body and being at least partly supported by the rim, the positioning member having at least one beak engageable with an opening in the lower cover plate.

17. An electric hotplate having electric heating elements adapted for automatic connection to electric power connecting lines, the hotplate comprising:

a hotplate body of highly thermally conductive material, the electric heating elements being positioned and secured to a bottom surface of the hotplate body and electrically insulated therefrom;

a lower cover plate attached on the underside of the hotplate body;

an electrically insulating mounting member arranged in a marginal region of the hotplate, the insulating member extending through the lower cover plate and carrying electric hotplate terminal lines from the heating elements in spaced relation, the terminal lines having stubs projecting from the insulating member; and, an electrically insulated positioning member for engaging the electric connecting lines and holding portions of the connecting lines at predetermined positions to ensure contact between the stubs and the portions, respectively, to facilitate automatic connection of respective stubs and portions to one another, the electrically insulating positioning member being a high temperature material, mounted on at least one of the lower cover plate and a peripheral rim of the hotplate body and being at least partly supported by the rim, the insulating member being countersunk in the cover plate.

18. An electric hotplate having electric heating elements adapted for automatic connection to electric power connecting lines, the hotplate comprising:

a hotplate body of highly thermally conductive material, the electric heating elements being positioned and secured to a bottom surface of the hotplate body and electrically insulated therefrom;

a lower cover plate attached on the underside of the hotplate body;

an electrically insulating mounting member arranged in a marginal region of the hotplate, the insulating member extending through the lower cover plate and carrying electric hotplate terminal lines from the heating elements in spaced relation, the terminal lines having stubs projecting from the insulating member; and, an electrically insulated positioning member for engaging the electric connecting lines and holding portions of the connecting lines at predetermined positions to ensure contact between the stubs and the portions, respectively, to facilitate automatic connection of respective stubs and portions to one another, the electrically insulating positioning member being a high temperature material, mounted on at least one of the lower cover plate and a peripheral rim of the hotplate body and being at least partly supported by the rim, the stubs of the terminal lines projecting out of the insulating member projecting no farther than a plane defined by a lower edge of the hotplate body.

* * * * *